United States Patent [19]

Quandel

[11] 4,282,974

[45] Aug. 11, 1981

[54] PLASTIC-ENCLOSED METAL BARREL

[75] Inventor: Siegfried Quandel, Neunkirchen, Fed. Rep. of Germany

[73] Assignee: Schäfer Werke GmbH, Neunkirchen, Fed. Rep. of Germany

[21] Appl. No.: 66,973

[22] Filed: Aug. 16, 1979

[30] Foreign Application Priority Data

Aug. 22, 1979 [DE] Fed. Rep. of Germany ... 7824992[U]
Dec. 2, 1979 [DE] Fed. Rep. of Germany ... 7835772[U]

[51] Int. Cl.[3] ..... B65D 21/02; B65D 1/46; B32B 1/02; G09F 3/00

[52] U.S. Cl. ..... 206/509; 40/307; 220/5 R; 220/71; 220/DIG. 1

[58] Field of Search ..... 206/509; 220/5 R, 71, 220/DIG. 1; 40/307

[56] References Cited

U.S. PATENT DOCUMENTS

| | | | |
|---|---|---|---|
| 2,613,462 | 9/1952 | Johnson | 40/307 |
| 2,983,403 | 5/1961 | Mauser | 220/71 |

FOREIGN PATENT DOCUMENTS

| | | | |
|---|---|---|---|
| 847688 | 7/1970 | Canada | 40/307 |
| 1267083 | 6/1961 | France | 220/DIG. 1 |
| 1007595 | 10/1965 | United Kingdom | 220/5 R |

*Primary Examiner*—George E. Lowrance
*Attorney, Agent, or Firm*—Blanchard, Flynn, Thiel, Boutell & Tanis

[57] ABSTRACT

A plastic encased metal barrel has annular stack edges of plastic, which axially project beyond the barrel bottom and top. The top and bottom stack edges form annular noses which project axially. The diameters of the annular noses are so related to one another that the annular nose on one stack edge can grip over the annular nose on the other stack edge. The top and bottom barrel ends are preferably arcuate and one end carries a bung socket. The outer coating or shell of plastic is preferably foam. The bung socket is surrounded by a reinforcing sheet metal plate enveloped by the plastic. The plastic coat forms a substantially plane surface which surrounds the bung socket and serves as an inscription field, wherein the inscription is formed at least in part by indentations in the plastic mass.

11 Claims, 4 Drawing Figures

PLASTIC-ENCLOSED METAL BARREL

FIELD OF THE INVENTION

The invention relates to a plastic-enclosed metal barrel with annular stack edges of plastic which project over the bottom or the lid of the barrel.

BACKGROUND OF THE INVENTION

Barrels of this type have the advantage, that the plastic sleeve forms a very good heat insulator, so that the barrel content, for example beer, is heated up only little even during transport which lasts several hours, so that a loss in quality due to too much heat is avoided. Also for handling plastic-enclosed barrels the plastic sleeve is advantageous because the plastic sleeve is insensitive to impacts due to its elasticity. As a result, a denting of the barrels does not occur not even during rough handling. The plastic sleeve also acts as a strong sound-absorber, so that noise is substantially avoided during the handling of the barrels.

In the case of barrels of this type with stack edges of plastic, the ends of the edges form planar surfaces, so that stacked barrels can slide easily. The purpose of the invention is to increase the stability of stacked barrels. For this purpose, the above-described barrel is constructed inventively such that the top and the bottom stack edge form annular noses which project axially and the diameter of the annular noses is determined such that the annular nose of one stack edge can grip over the annular nose of the other stack edge.

According to a further development of the invention, the inside diameter of the annular nose of the top stack edge is larger than the outside diameter of the annular nose of the bottom stack edge. In this way, the base annular surface is moved inwardly. This has the advantage that sliding marks, which are created during pulling of the barrels over rough surfaces, do not become visible on the outer edges of the barrel. Furthermore the base surface area can be made large without having to exceed the mentioned outside diameter of the barrel.

According to a further development of the invention, handle or outlet openings are provided in the stack edges. This makes possible the comfortable handling of the barrel. The accumulation of liquid, for example water, within the stack edges is avoided through the outlet openings.

If one shifts the handle and outlet openings 90° or approximately 90° from the parting plane of the plastic mold, simple manufacturing molds are obtained, since the mentioned openings can be formed through parts which are connected fixedly to the mold.

A further improvement on a plastic-enclosed barrel relates to a barrel with an inner shell of sheet metal, which is preferably made arcuate in the area of the bottoms of the barrel and which has a bung socket, and a coat, or shell, preferably out of a foamed plastic, wherein the bung socket is surrounded by one reinforcing sheet metal plate which is enclosed by the plastic.

Barrels must be marked for various reasons, wherein mostly a type of a basic inscription, which is identical on a whole series of barrels, and a special inscription which is different for individual barrels or for smaller barrel groups, exists. The basic inscription relates for example to the name of a brewery and the special inscription for example to a barrel numbering. These inscriptions are placed on a bottom of a barrel. This place has the advantage that the inscription is protected well against damage.

In known barrels relatively complexly formed reinforcing sheet metal plates are used, which have the purpose to introduce forces which engage the bung socket as good as possible into the barrel body. The upper sides of the reinforcing sheet metal plates lie free. Symbols can be applied on such reinforcing sheet metal plates by means of expensive imprinting tools. The applying of special inscriptions on the finished barrel would be problematic, since damage of the barrel is to be feared during hammering in of the symbols.

The further improvement is aimed at constructing a barrel of the above-mentioned type such that an inscription can also be applied to a finished barrel, without danger of damage of the barrel.

This is achieved by the plastic shell forming a substantially plane surface which surrounds the bung socket and which serves as an inscription field, wherein the inscription consists at least partially of indentations in the plastic mass.

The plastic shell is inventively utilized to form, in spite of the inner shell which is arced generally in the bottom area for the reason of solidity, a flat inscription surface. The basic inscription can be formed in this inscription surface during injection around the inner shell, by mounting the letters and numbers which form the inscription in the injection mold. The special inscription can also be created easily through melting of letters and numbers or other symbols into the inscription surface. During this type of application damaging pressure is not applied to the barrel bottom, so that danger of damage does not exist. For example barrel numbers, official calibration symbols, the fill date and many other more can be melted in. Damage of the barrel bottom is also prevented with certainty by the inscription being provided above the reinforcing sheet metal plate, so that a deformation of the barrel bottom is avoided with an absolute certainty.

The outer contour of the inscription surface can vary. Generally, however, one will make this surface substantially circular. Advantageous is the provision of elevated or recessed fields at the points at which a special inscription is supposed to be applied, because through this the respective places are well recognizable and thus application of the notice at an incorrect place is surely avoided.

The bung socket preferably carries a surrounding recess, preferably below a reinforcing ring and the plastic shell engages said recess. The recess can also extend downwardly through the reinforcing sheet metal plate. With this one obtains great security against a loosening of the plastic shell in the area of the socket.

The reinforcing sheet metal plate rests advantageously on a stop shoulder of the bung socket and is clamped between this stop shoulder and the inner shell which is welded to the bung socket. This avoids a special installation operation for the fastening of the reinforcing sheet metal plate.

BRIEF DESCRIPTION OF THE DRAWINGS

The invention will be discussed in more detail hereinafter in connection with the drawings, in which.

DETAILED DESCRIPTION

Figure 1:
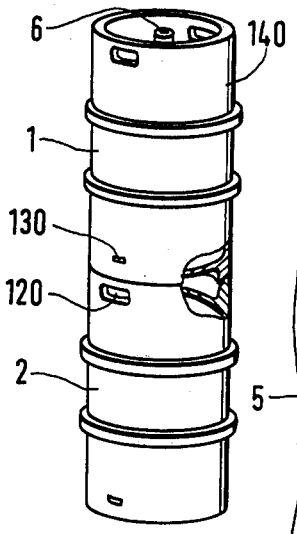
FIG. 1 is a perspective view of two stacked barrels.
Figure 2:
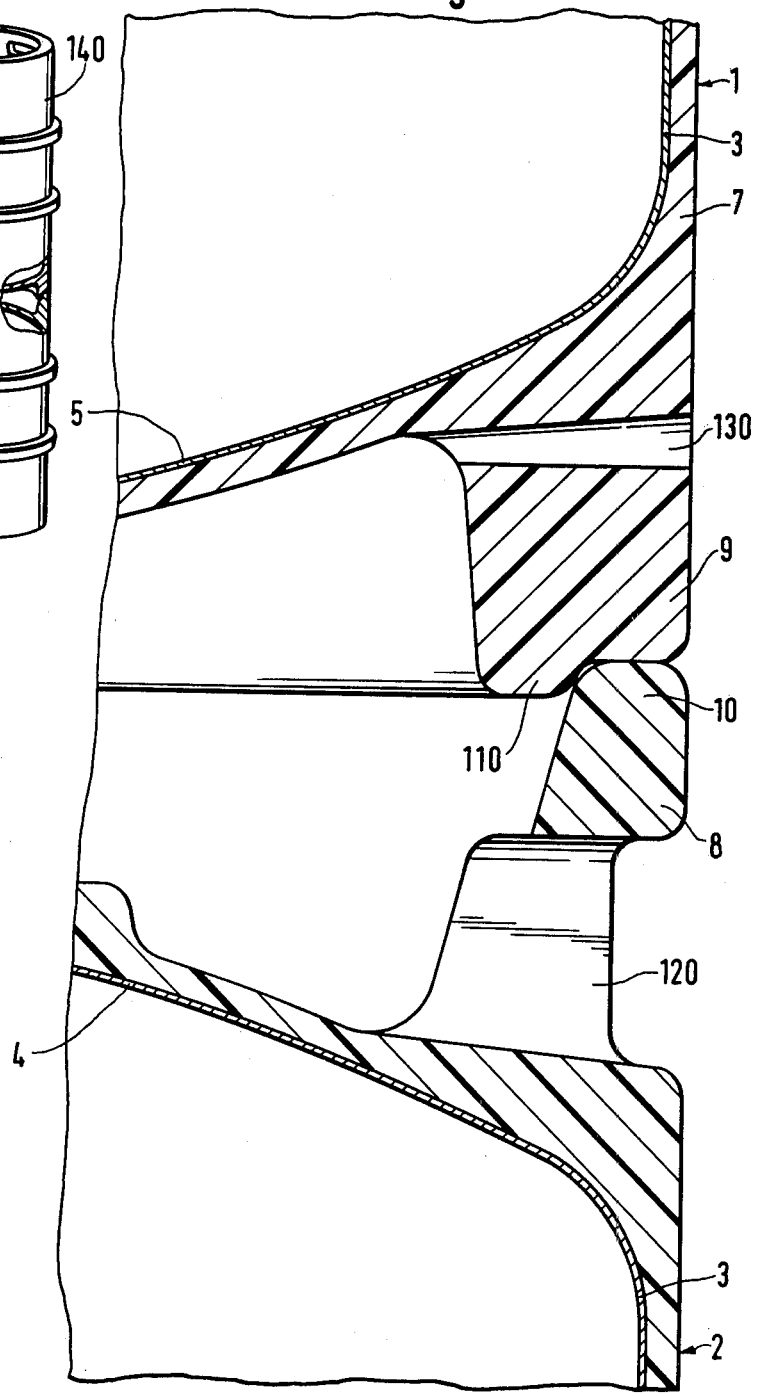
FIG. 2 is a fragmentary, enlarged, central cross-sectional view of the cooperating stack edges of the barrels according to FIG. 1.

The barrels 1 and 2 illustrated in FIGS. 1 and 2 comprise a closed metal bubble 3, which simultaneously forms the top 4 and the bottom 5 of the barrel. The top 4 carries the barrel rim 6, which is visible in FIG. 1. A plastic shell 7 closely surrounds the metal bubble, which shell forms at the same time two stack edges, namely the top stack edge 8 and the bottom stack edge 9. The stack edges project beyond the top and bottom respectively to form respective projecting, annular noses 10 or 110. The diameters of the noses are determined such that the inside diameter of the nose 10 is larger than the outside diameter of the nose 110, namely the nose 10 forms a guideway for the nose 110, which prevents lateral sliding of the barrels.

Outlet openings 120 or 130 exist in the stack edges. The openings 120 are constructed simultaneously as handle openings.

The openings 120 and 130 are offset 90° with respect to the dividing plane of the mold (marked by the thin line 140 in FIG. 1). Therefore during opening of the mold it is possible to pull molding parts, which are connected fixedly to the mold, out of the openings 120 and 130.

Figure 3:
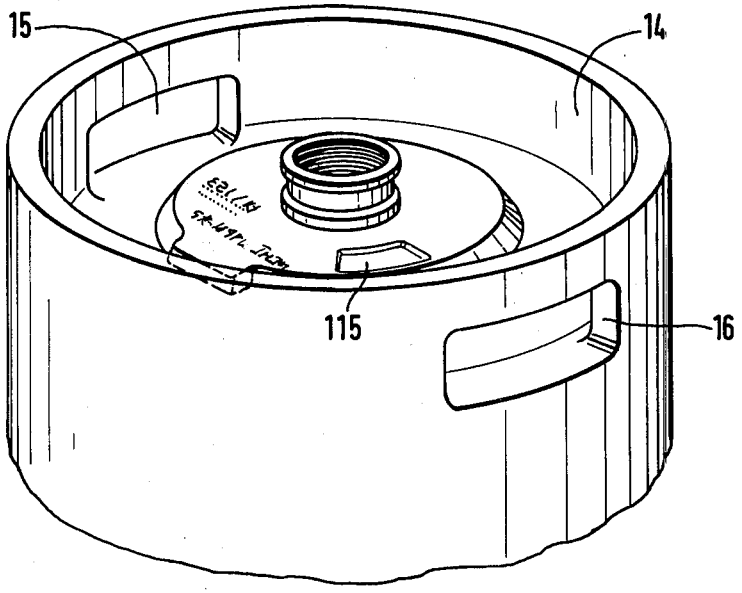
FIG. 3 is a perspective illustration of the upper end of a barrel with an enclosed reinforcing sheet metal plate.
Figure 4:
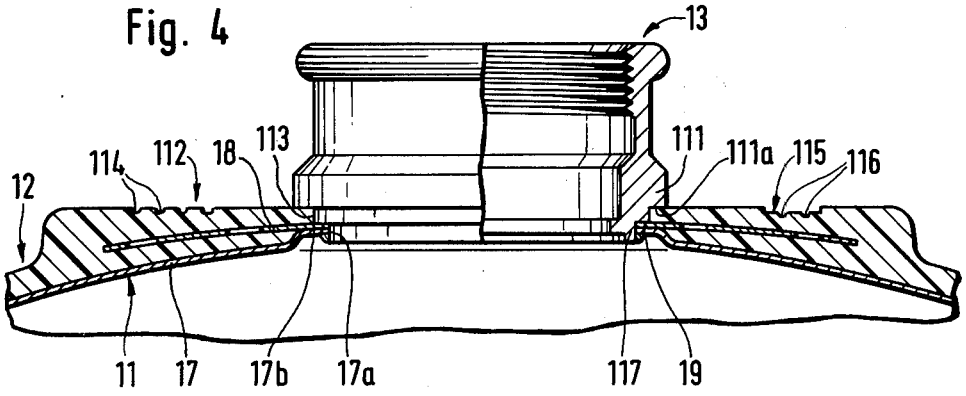
FIG. 4 is a fragmentary view, partially in central cross-section, of the barrel according to FIG. 3 in a scale larger than that of FIG. 3.

The barrel according to FIGS. 3 and 4 has an inner shell of sheet metal, preferably of steel plate, which is identified as a whole by reference numeral 11, an outer shell which is identified as a whole by reference numeral 12 and a bung socket 13. The barrel has as a whole a cylindrical form. The plastic shell forms a protective collar 14 at each axial end of the barrel, which collar has handle holes 15 and 16. The inner shell 11 has approximately ball-shaped arced bottoms 17.

The bottom 17 has a circular opening 17*a*, which is surrounded by a bead 17*b*. A reinforcing sheet metal plate 18 rests on the upper side of the bead 17*b*, which plate is arced ball-shaped, wherein the arc is less definite than the arc of the bottom of the barrel 17. The reinforcing sheet metal plate is preferably perforated. The perforations can be produced during the same sequence of operation, in which the sheet metal plate 18 is made arcuate.

The sheet metal plate 18 rests against a stop shoulder 19 of the bung socket 13. A centering edge 117 is provided below the stop shoulder 19. A reinforcing ring 111 is formed on the bung socket 13 above the reinforcing sheet metal plate 18, the underside 111*a* of which ring 111 is spaced from the upper side of the reinforcing sheet metal plate 18.

The barrel bottom 17 and socket 13 are welded together. The reinforcing sheet metal plate 18 is clamped between the bead 17*b* and the stop shoulder 19. Since during welding of the bottom 17 to the socket 13 a kind of a shrinkage effect is achieved, the reinforcing sheet metal plate 18 is held very fixedly in its clamping position without itself being welded to the socket.

After welding in of the socket, which is done from the inside of the barrel, the inner shell 11 is fixed in a foaming mold and is foamed around by plastic, whereby the shell 12 is formed. A planar inscription surface, which as a whole is identified by reference numeral 112, is created during this foaming, and the reinforcing sheet metal plate 18 is totally enveloped in plastic. The plastic also penetrates the groove 113, which is defined at the bottom by the reinforcing sheet metal plate 18 and at the top by the under surface 111*a* of the reinforcing ring 111. During foaming it is also possible to apply the basic inscription right away, for which reason letters and numbers are provided in the foaming mold. The identations 114 are supposed to indicate this basic inscription. Furthermore, during foaming indented fields 115 may be formed, in which later a special inscription can be located, for example an official calibration symbol. Heated stamps are used for this, which are heated up to such a temperature that the plastic will melt during the impression of the stamp. In this manner permanent identifications can be provided. These are indicated by identations 116 in FIG. 4. The pressure of the stamp is not damaging, since on the one hand only a small pressure is needed and on the other hand the reinforcing sheet metal plate 18 also lies above the inner shell 17. Even if, due to incorrect handling of the covering plastic, melting down to the sheet metal plate 18 should occur, damage to the inner shell 17 still need not be feared.

Since the basic inscription is formed during foaming around the inner shell 11, the basic inscription could also be made raised. However, for the special inscription the indented arrangement is the most advantageous one, because thereby only relatively little plastic material must be melted.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a barrel including an inner shell of sheet metal arced in the area of the barrel bottoms and on which is provided a bung socket, and further including a coat of plastic, said bung socket being surrounded by a reinforcing sheet metal plate enveloped by said plastic coat, the improvement comprising wherein said reinforcing sheet metal plate encircles said bung socket and includes at least a portion thereof which is spaced from said barrel bottom, wherein said plastic coat is received in the spacing between said portion of said reinforcing sheet metal plate and said barrel bottom and encases said reinforcing sheet metal plate therein, wherein said plastic coat at the end which encases said reinforcing plate therein forms a substantially planar surface which encircles said bung socket and defines an inscription field, and wherein said inscription field consists at least partially of indentations in said plastic coat.

2. A barrel according to claim 1, wherein said substantially planar surface has a substantially circular shape.

3. A barrel according to claim 1, wherein within said planar surface there is arranged at least one elevated or recessed field.

4. A barrel according to claim 1, including an annular recess on and encircling said bung socket, said recess being defined by a lip on said bung socket and a surface on said reinforcing sheet metal plate, said plastic coat being received in said recess.

5. A barrel according to claim 4, wherein said recess is limited downwardly by said reinforcing sheet metal plate.

6. A barrel according to claim 1, wherein said reinforcing sheet metal plate rests on a stop shoulder on said bung socket and is clamped between said stop shoulder and said inner shell, and wherein said inner shell is welded to said bung socket.

7. A barrel according to claim 1, wherein said plastic coat has annular stack edges formed thereon and projecting axially beyond said barrel bottom and said barrel top, wherein said top and bottom stack edges have annular noses formed thereon and which project axially, and wherein the diameters of said annular noses are so related to one another, that the annular nose of the one stack edge can grip over and encircle the annular nose of the other stack edge.

8. A barrel according to claim 7, wherein the inside diameter of the annular nose of said top stack edge is larger than the outside diameter of the annular nose of said bottom stack edge.

9. A barrel according to claim 7, wherein the outer diameter of each stack edge is of the same size or smaller than the outside diameter of said plastic coat of said barrel.

10. A barrel according to claim 7, including handle or outlet openings provided in said stack edges.

11. A barrel according to claim 10, wherein said handle and outlet openings are offset approximately 90° from a parting plane of a plastic mold.

* * * * *